US008215920B2

(12) United States Patent
Criner et al.

(10) Patent No.: US 8,215,920 B2
(45) Date of Patent: Jul. 10, 2012

(54) CEILING FAN

(76) Inventors: Jerry D. Criner, Branford, CT (US); Jodi B. Young, Branford, CT (US)

( * ) Notice: Subject to any disclaimer, the term of this patent is extended or adjusted under 35 U.S.C. 154(b) by 576 days.

(21) Appl. No.: 12/459,269

(22) Filed: Jun. 29, 2009

(65) Prior Publication Data

US 2010/0329885 A1 Dec. 30, 2010

(51) Int. Cl.
*F04D 29/60* (2006.01)

(52) U.S. Cl. ..... 416/244 R; 248/343

(58) Field of Classification Search ..... 248/222.52, 248/225.11, 345, 344
See application file for complete search history.

(56) References Cited

U.S. PATENT DOCUMENTS

| | | | | |
|---|---|---|---|---|
| 4,808,071 | A | 2/1989 | Chau | |
| 5,069,601 | A | 12/1991 | Shawcross | |
| 5,845,886 | A | 12/1998 | McCormick | |
| 5,947,436 | A | 9/1999 | Bucher et al. | |
| 6,171,061 | B1 | 1/2001 | Hsu | |
| 6,648,488 | B1 | 11/2003 | Pearce | |
| 6,653,558 | B1 | 11/2003 | Bucher et al. | |
| 6,979,108 | B1 | 12/2005 | Berge | |
| 7,028,963 | B1 | 4/2006 | Silva et al. | |
| 7,249,744 | B2 * | 7/2007 | Bacon et al. | 416/244 R |
| 7,306,191 | B1 | 12/2007 | Chen | |
| 2002/0163812 | A1 | 11/2002 | Tseng | |

FOREIGN PATENT DOCUMENTS

JP 05157092 A * 6/1993

* cited by examiner

*Primary Examiner* — Richard Edgar
(74) *Attorney, Agent, or Firm* — Robert E. Massa

(57) ABSTRACT

A ceiling fan comprising bracket components which are easily and conveniently attachable in a suitable position by one person thru simple operation and adjustment of mechanical parts. Attachment components are removably secured to a ceiling plate connected to a house circuit in an initial room then capable of easy removal therefrom and attachable to a ceiling plate installed in another room. A fan circuit is connectable to a house circuit by simple plug members and fan unit is quickly positionable into a secure position by position against and rotation of cooperable components with ceiling plate.

12 Claims, 6 Drawing Sheets

CEILING FAN

FIELD OF THE INVENTION

Our invention relates to ceiling fans, particularly to ceiling fans which are constructed to be easily and conveniently attachable into position and easily and conveniently removable from an attached position. Further, our invention relates to ceiling fans which are easily and conveniently handled by one person in either an attachable operation or a removable operation. Still more particularly, our invention relates to ceiling fans which do not involve the attachment of security-related components when being attached to the ceiling, or the removal of such security-related components, such as a screw, or nut and bolt, when being removed from position. The attachment of our fan is easy and simple, and the only actions required are the plugging into a house circuit and a slight rotation of the fan to obtain the attachment into place. The construction of the fan permits the entire operation to be performed by one person, and safely.

BACKGROUND OF THE INVENTION

Many ceiling fans have been designed to carry out particular services. As with all inventions, a patent is the assurance of an improvement in the art. With ceiling fans, the improvements providing the most advantage and convenience are the components which hold the fans in a firm position against the ceiling of the ceiling of the building structure. Normally, these involve some type of bracket structure designed to act as a cooperating link between some portion of the ceiling fan and the ceiling, or even some modification of a portion of a ceiling fan itself to permit the ceiling fan to be held in position by means of a long screw. In such instances, a ceiling fan was not intended to be readily detachable from its current substantial position.

We contemplated the design of a ceiling fan which could be easily and quickly removed from a current attachment position against the ceiling of one room in our house and then easily and conveniently installed at a place of suitable attachment in another room, all steps to be accomplished by one person.

We analyzed carefully what the procedure would be in removing a ceiling fan which is currently in a permanent position. In doing so, we can describe the steps necessary:

1. Shut off the electricity at the breaker box.

2. Remove the canopy trim from the ceiling fan.

3. Unscrew the three screws holding the canopy component to the ceiling plate.

4. Then, a second person is needed to hold the fan while the first person disconnects the four wires from the house circuit.

We made particular note of the operation, and of what could be simplified to accomplish our thoughts.

Obviously, the major steps in removing a ceiling fan are the disconnection from the house circuit and the difficulty in unscrewing the long screws holding the fan in place.

Thus, in considering a possible manner in which a ceiling fan might be improved, we eventually developed the invention which we are describing herein.

Then, in accordance with the usual practice, we conducted a patent search which revealed the following patents which were considered to be the most closely related to our invention:

| | | |
|---|---|---|
| U.S. Pat. No. 4,808,071 | Chau | Feb. 28, 1989 |
| U.S. Pat. No. 5,069,601 | Shawcross | Dec. 3, 1991 |
| U.S. Pat. No. 5,845,886 | McCortmick | Dec. 8, 1998 |
| U.S. Pat. No. 5,947,436 | Bucher et al | Sep. 7, 1999 |
| U.S. Pat. No. 6,171,061 | Hsu | Jan. 9, 2001 |
| U.S. Pat. No. 6,648,488 | Pearce | Nov. 18, 2003 |
| U.S. Pat. No. 6,653,558 | Bucher et al | Nov. 25, 2003 |
| U.S. Pat. No. 6,979,108 | Berge | Dec. 27, 2005 |
| U.S. Pat. No. 7,028,963 | Silva et al | Apr. 18, 2006 |
| U.S. Pat. No. 7,306,191 | Chen | Dec. 11, 2007 |
| U.S. Pat. App. 2002/0163812 | Tseng | Nov. 7, 2002 |

U.S. Pat. No. 4,808,071, to Chau relates to a ceiling fan. The switch unit is readily adaptable from the fan motor for service. FIGS. 2 and 3 show a unique switch unit with the clamp in open and closed positions.

U.S. Pat. No. 5,069,601, to Shawcross describes a ceiling fan which has a removable blade hub and switch housing adapter plate which enables replacement of the blade hub without removing the components which secure the blade in place.

U.S. Pat. No. 5,845,886, to McCormick describes an adjustable ceiling fan for use in various recreational vehicles. The fan is positioned on a spring-biased adjustable support which is formed of two parallel members placed between opposite walls of the vehicle.

U.S. Pat. No. 5,947,436, to Bucher et al describes a canopy hole cover assembly for a ceiling fan, particularly a hanger bracket device, intendant to conceal the mechanical units from view. The patent briefly mentions the use of "light kits" but does not describe any. The patent more specifically shows its adaptation to the slanted walls of a cathedral.

U.S. Pat. No. 6,171,061, to Hsu describes a suspending bracket for a ceiling fan constructed of two portions which are easily assembled. FIG. 3 shows the manner in which the device is assembled.

U.S. Pat. No. 6,648,488 to Pearce describes a ceiling fan and light kit assembly which is produced for quick assembly. The light kit is shown in Figures and 3 as being assembled.

U.S. Pat. No. 6,653,558, to Bucher et al describes numerous versions of a ceiling fan in which the bracket assembly 10 is easily mountable to an electrical box, or other support device which is installed within a ceiling. In FIGS. 1 and 22 inventor shows a tether 80 connecting the male and female brackets to allow the two fixtures to hang while the device is being connected to the house wiring.

U.S. Pat. No. 6,979,108 to Berge describes various components of bracket means for securing a light in position.

U.S. Pat. No. 7,028,963, to Silva et al describes various forms of a mounting bracket for securing a ceiling light in position.

U.S. Pat. No. 7,306,191, to Chen describes a suspension structure for hanging a ceiling fan.

U.S. Pat. Application 2002/0163812 to Tseng describes a fast assembly structure for a ceiling fan and ceiling lamp.

SUMMARY OF THE INVENTION

The primary object of our invention is to provide a ceiling fan device which is easily and conveniently attachable to or removable from a ceiling position and which is safe while doing so.

Another object of our invention is to provide a ceiling fan device which may be easily and conveniently handled a single person during either removal from a present ceiling position or attachment to a subsequent site.

Still another object of our invention is to provide a ceiling fan device which comprises an easily attachable electrical component which is adaptable to cooperate with an easily attachable holding component.

Still another object of our invention is to provide a multiplicity of bracket components for a ceiling fan as they would be placed in proper positions so that the owner may have a choice of location for attachment of a fan.

Still another object of our invention is to provide a ceiling fan which may be easily and quickly removed from a current attachable position and easily and quickly attachable to a chosen remote position with an adaptable holding component.

Still another object of our invention is to provide a ceiling fan component to which other useful light weight components may be attachable for useful operation or ornamentation.

We feel certain we followed the most historical manner in developing our invention. Precisely, we have invented and developed our ceiling fan attachment from what we consider to be the most logical steps in developing a new product.

We simply began to think that it would be of great advantage to have a ceiling fan that could be easily movable from one room to another, since the present devices are secured in place and are too heavy for one person to handle.

We want to emphasize other advantages we see in our invention in addition to primary objects.

For example, with our easily removable ceiling fan, we do not have to pay for, or depend upon, an electrician for removal of our fan. And, because it is easily and quickly handled, it is easily removed for periodic cleaning.

Another important point about our ceiling fan is that our easily and quickly connectable ceiling fan can be kept in a clean and healthy condition because it can be so easily taken outside for a thorough cleaning when necessary, much more easily than a heavy device which could not be easily moved.

These and other objects that we find for our invention, and, a thorough and authentic description of our invention, may now be shown by the following drawings and written description.

DESCRIPTION OF THE PREFERRED EMBODIMENTS

Figure 1:
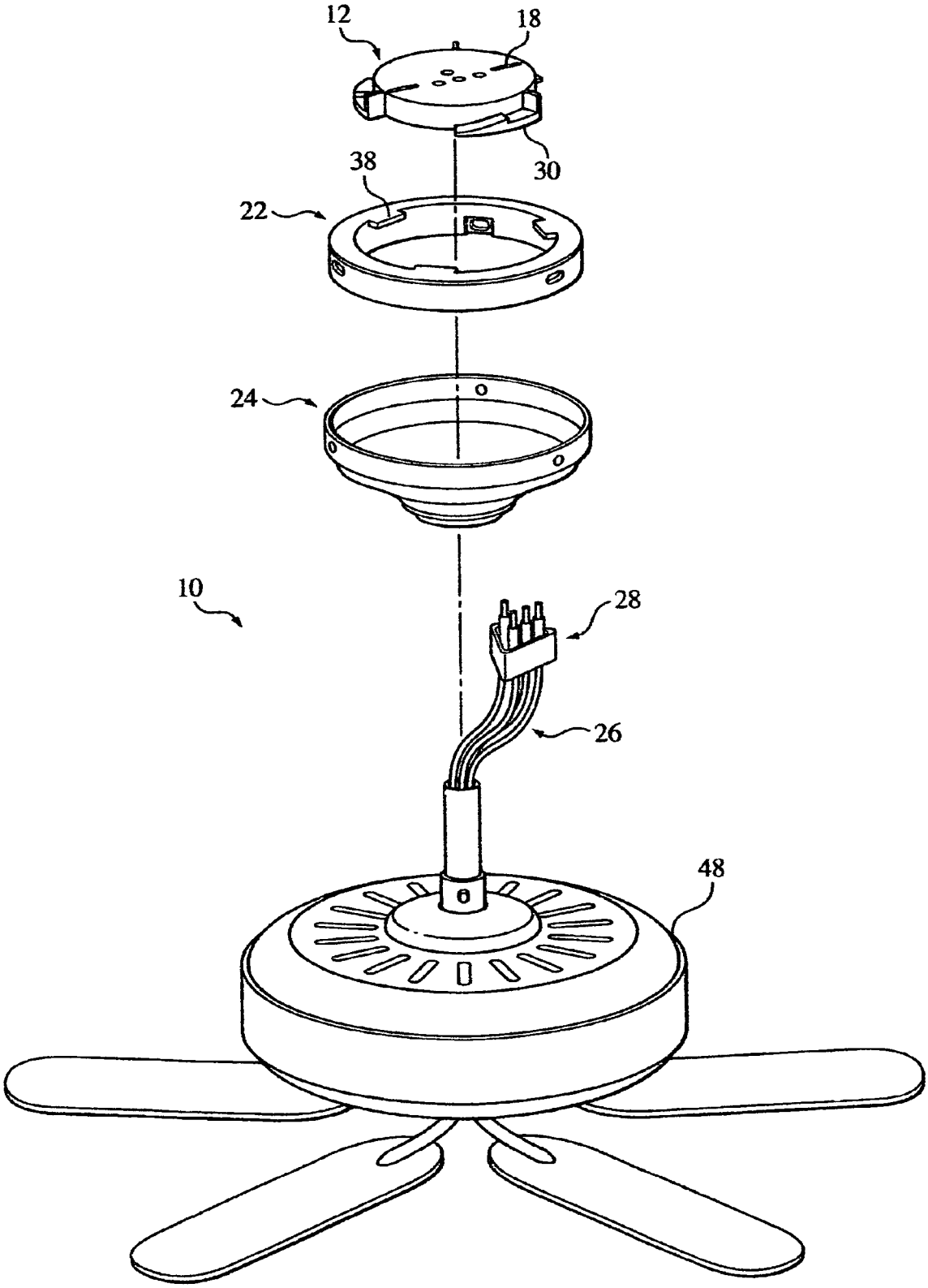
FIG. 1 is an exploded view of the components of our ceiling fan device as they would be arranged in position for assembly.

In FIG. 1 we describe one embodiment of a ceiling fan device 10, generally, according to our invention. In this exploded view of FIG. 1, we show the major components of our ceiling fan 10 as they would be arranged in the most easily understood positions and order for assembly and installation against a ceiling of a house.

Figure 7:
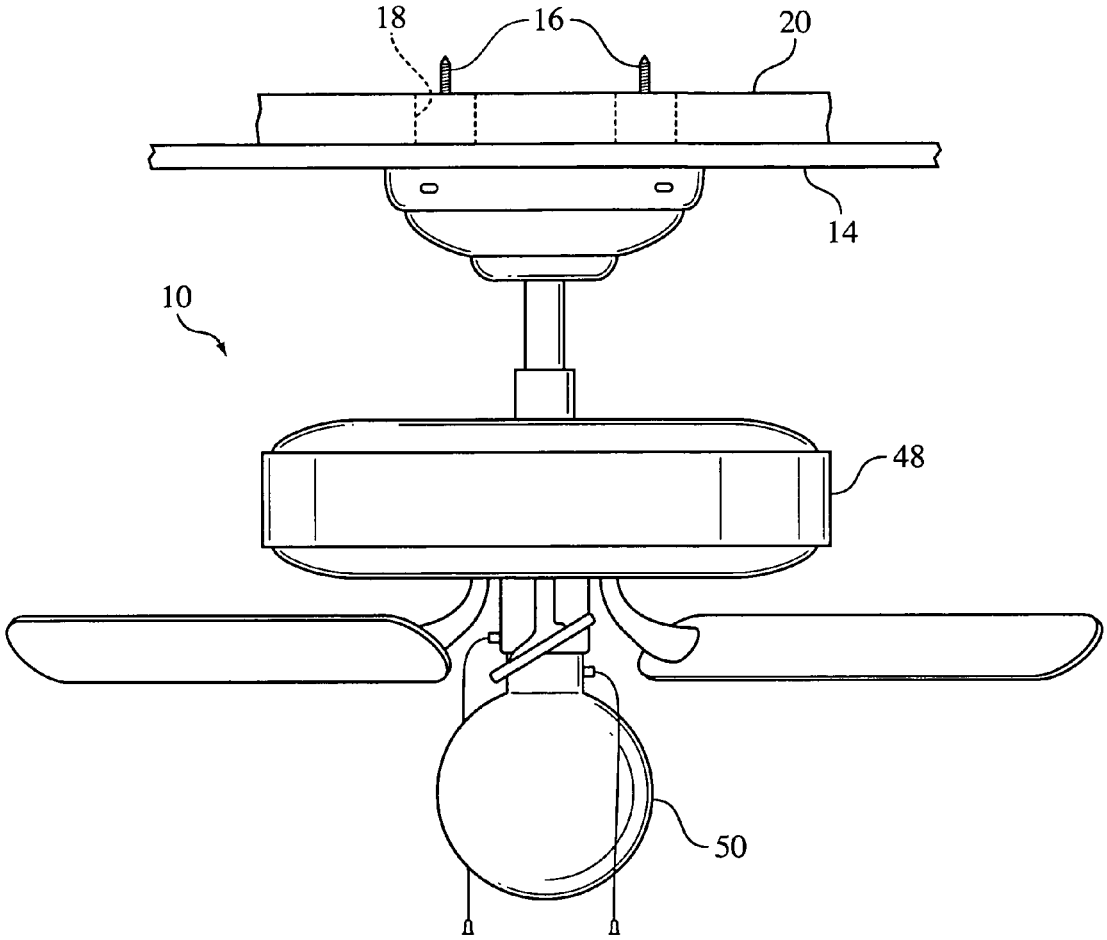
FIG. 7 is a side view of a ceiling fan and light according to our invention in a fully assembled condition.

The uppermost component is a first bracket member as shown by a ceiling plate 12, generally, which holds the entire ceiling fan device in place against a ceiling, 14, generally, by means of screws 16 extending thru slots 18 as shadow in FIG. 7.

As we have planned for easy handling and movement of our ceiling fan, we plan a ceiling plate 12 to be placed securely against the ceiling in any room where we want to feel comfortable with a ceiling fan 12, so that we secure only a ceiling plate 12 in position. If we have access to a sturdy beam 20, generally, we are able to provide means for the screws 18 to be in a more secure position.

FIG. 1 shows the major components of our device in a proper arrangement for assembly, after a ceiling plate 12, has been placed in secure position, and includes a second bracket member as shown by fan plate component 22, generally, which is initially secured to a desired ceiling fan device in a manner that will provide the entire easy and convenient attachment in place of a ceiling fan by means of a simple rotational movement when a ceiling fan device is properly placed against ceiling plate 12.

A canopy 24, generally, is a typical original piece of equipment and serves mostly to provide protection and ornamentation for operating components, since wire connecting members 26, generally, which are connected to the ceiling fan motor and are assembled and carried together to a plug component 28, generally, to pass thru canopy 24, and fan plate component 22 to make connection with a house circuit during installation of the unit.

In what would have to be a difficult installation operation for at least two persons working together, we have made simple; and easy enough for a single person to complete without any hesitancy, merely by the design and cooperation of components as we exemplify in FIGS. 2 thru 6.

As we want to emphasize, the most important feature of our invention is the simple cooperation of ceiling plate 12, generally, fan plate 22, generally, and plug component 28, generally.

Thus, we have designed fan plate 12 to include a form of support member 30, generally, extending from a side thereof which further includes a ramp portion 32 leading to and dropping off to a horizontally disposed portion 34 at the end of which is a vertically disposed retainer member 36.

Then, as shown in the properly oriented position in FIG. 1, and suggested thereby, fan plate component 22, generally, is positioned against ceiling plate 12 in the proper orientation by which a tab component 38 is resting against the upper surface of ramp portion 32 of ceiling plate 12. Then, a slight rotation of fan plate 22, as it is attached to the fan unit, permits tab component 38 to slide along ramp portion 32, then to fall neatly into a locking position within a horizontally disposed portion 34, to be held further in position by retainer portion 36. Of course, in operation, a fan bears downwardly with its weight to enhance its security.

Figure 2:
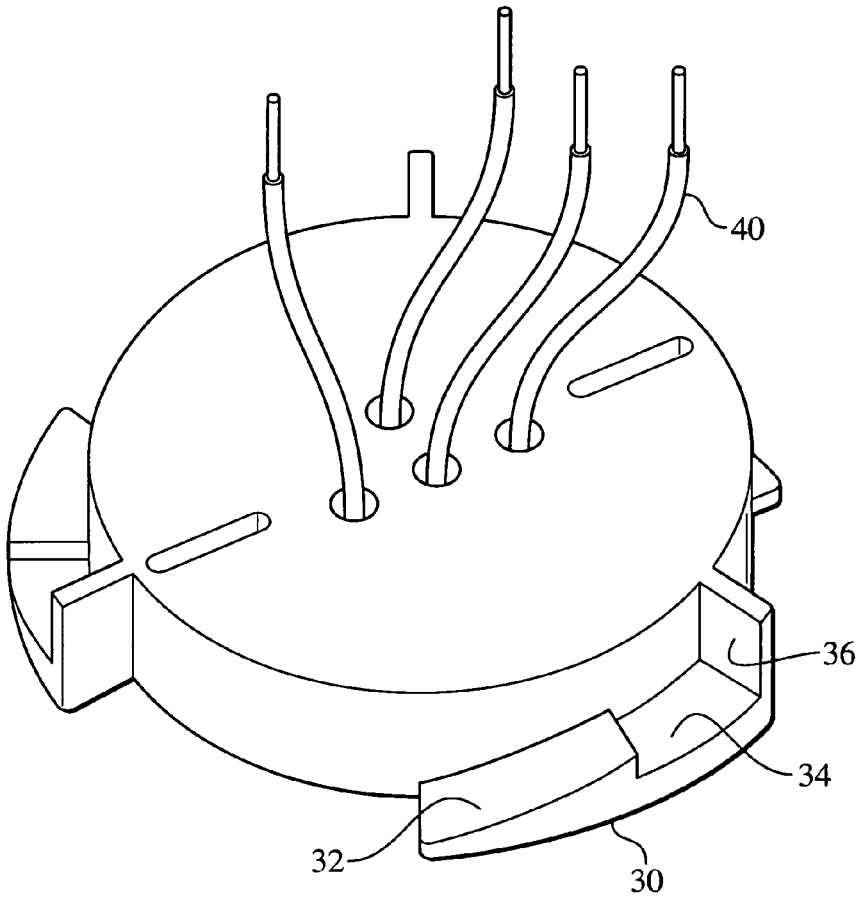
FIG. 2 is a perspective view of a ceiling plate component of a ceiling fan device according to our invention showing wire components in position for connection to a house circuit.
Figure 3:
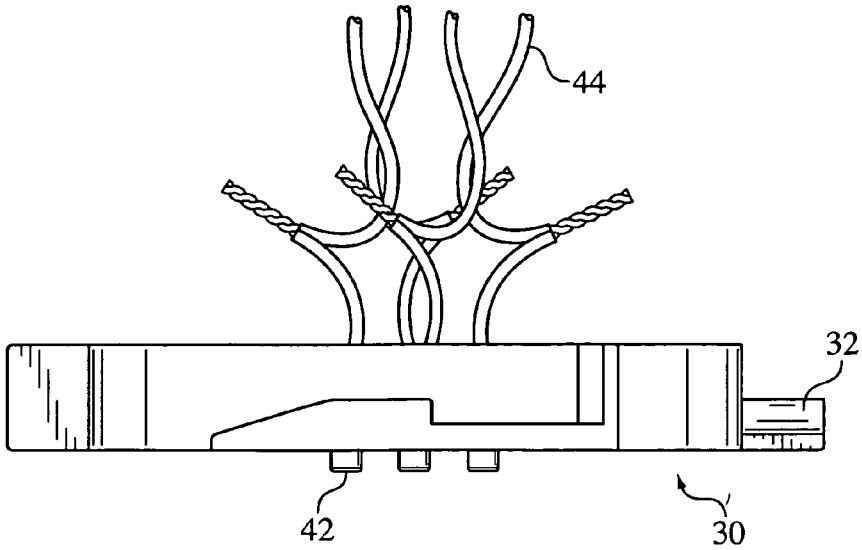
FIG. 3 is a side view of a ceiling plate component according to our invention emphasizing attachable components of our fan.
Figure 4:
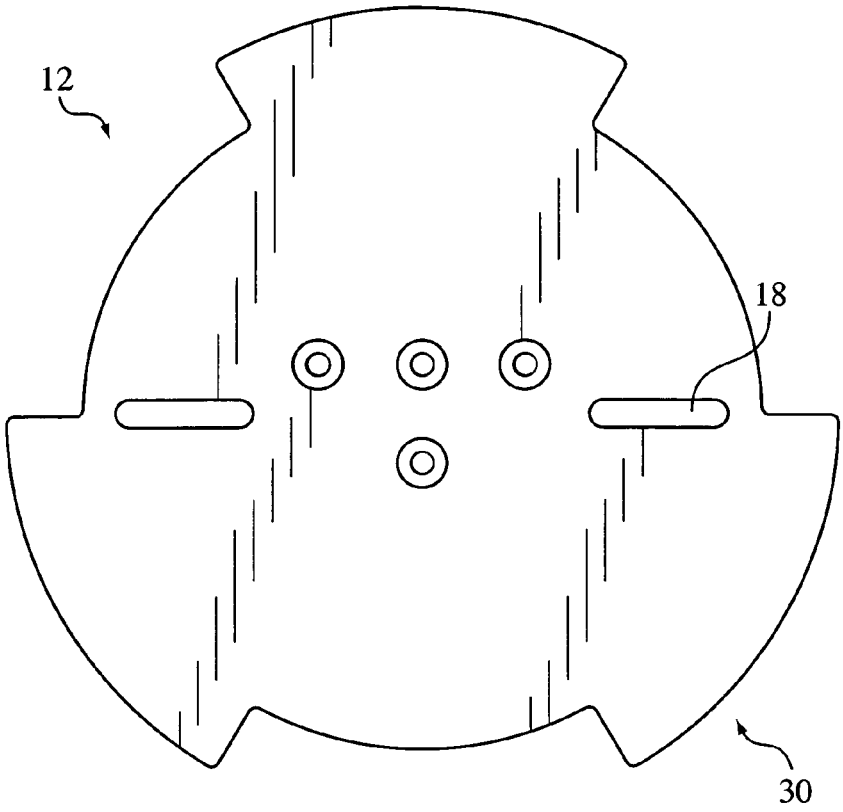
FIG. 4 is a bottom view of a ceiling plate component according to our invention showing the positions of connection points.
Figure 5:
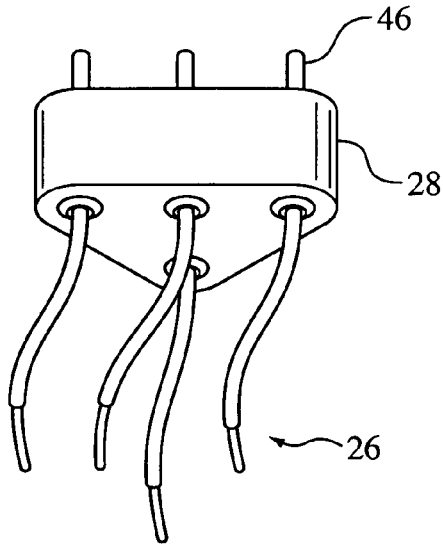
FIG. 5 is a perspective view of a connection assembly component according to our invention.
Figure 5A:
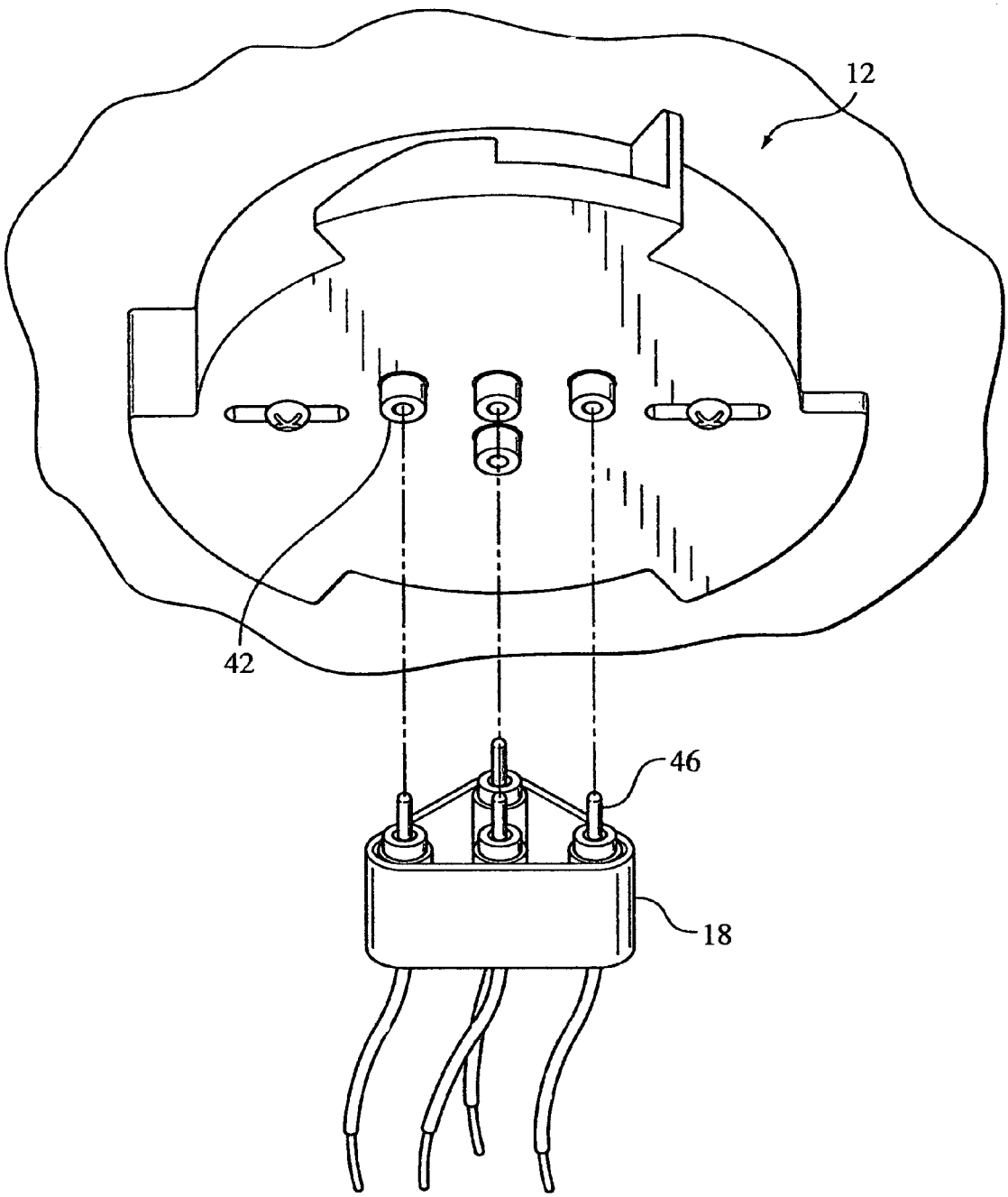
FIG. 5A is a perspective view of a connection assembly component according to our invention.
Figure 6:
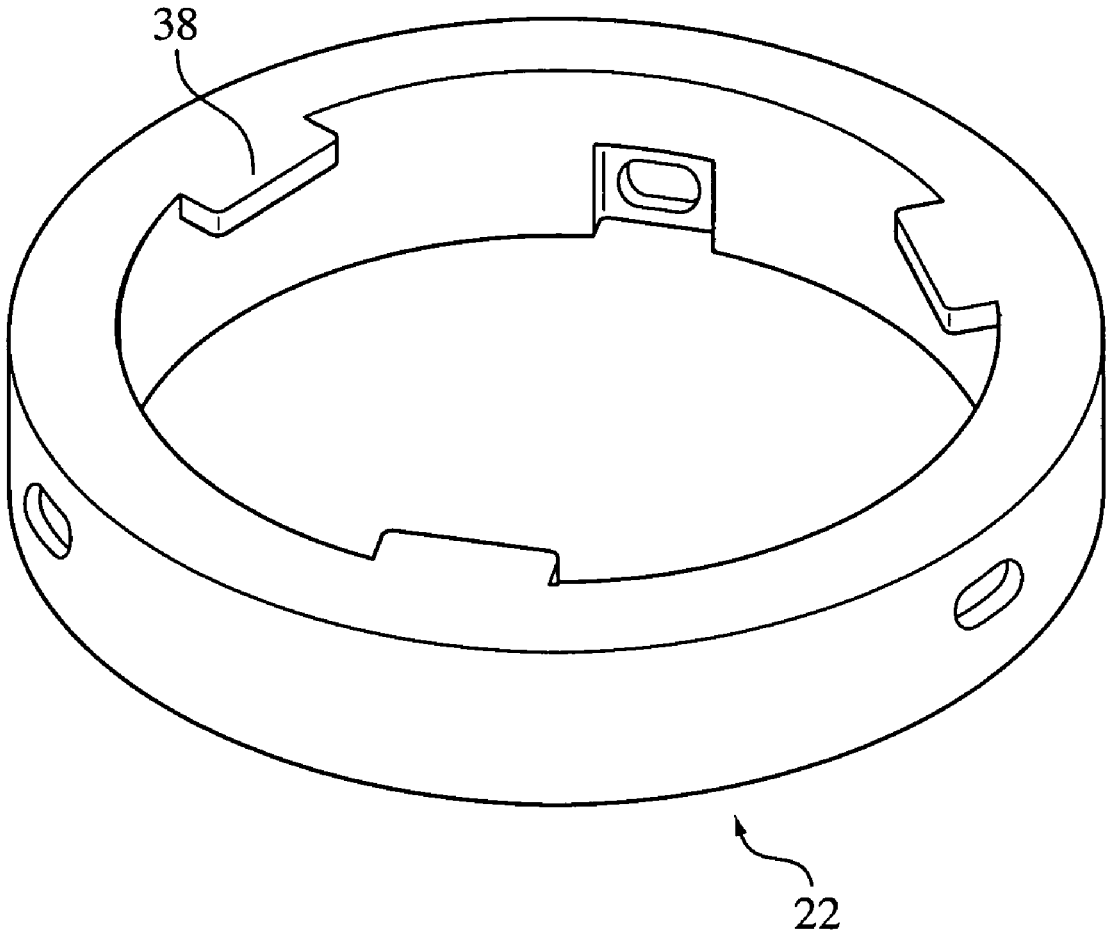
FIG. 6 is a perspective view of a fan plate component according to our invention.

FIGS. 2 and 3 describe a ceiling plate 12, generally, according to our invention, in a more elaborate position, with wire components 40 connected to conductor members, shown as jacks 42, positioned in ceiling plate 12 before being firmly connected to wire components 44 of a house circuit, as shown in FIG. 3. In FIG. 3 we also show lower extensions of conductor members 42 as they extend from bottom of ceiling plate 12, as they provide the manner in which a set of prongs 46, secured on plug components 28, to provide a simple and convenient attachment of the fan to the house circuit 44.

Thus, as we simplify, ceiling plate 12 is secured to the ceiling 14, and wire connections 40 are secured to house circuit wires 44, an as many places as the owners wish, then, the movable components are ready for quick and convenient attachment as desired.

As we modified a traditional ceiling fan 48, generally, with the components we describe herein, we are aware that the device we have developed provides a product of a light, easily handled weight, around seven pounds, which may include a light component 50, generally, in a manner that rests securely in place, and is ready for quick and easy removal and installation.

Since many different embodiments of our invention may be without departing from the spirit and scope thereof, it is to be understood that the specific embodiments described in detail herein are not to be taken in a limiting sense, since the scope of the invention is best defined by the appended claims.

We claim:

1. A bracket system to provide quick and easy mountability for a ceiling fan, comprising:

a first bracket component secured to a ceiling having a support member positioned at a side thereof comprising a ramp portion leading to a horizontally disposed portion of said support member, and a wire on an upper side of said first bracket secured to a house circuit and to a jack positioned in said first bracket, and a second bracket component attachable to a ceiling fan, said second bracket having a tab at a side thereof oriented to cooperate with said support member, and a plug assembly comprising an insulated component holding a plug member which is electrically connected to said ceiling fan and is electrically adaptable to fit receivably into said jack of said first bracket, whereby installing a ceiling fan comprises merely plugging said plug member into said jack member, then rotating said ceiling fan while said tab component is moving slidably along said ramp portion to move into a secure position against said horizontally disposed portion, thus securely positioning said ceiling fan.

2. A bracket system to provide quick and easy mountability for a ceiling fan, as described in claim 1, wherein:

said support member, including said ramp portion and said horizontally disposed portion, extends outwardly from a side of said first bracket component, and said tab extends inwardly from a side of said second bracket component.

3. A bracket system to provide quick and easy mountability for a ceiling fan, as described in claim 2, wherein:

said support member includes a vertically disposed retainer member at an end of said horizontally disposed portion.

4. A bracket system to provide quick and easy mountability for a ceiling fan, as described in claim 3, wherein:

said bracket system comprises a set of three support members distributed equally around said first bracket component, and said bracket system comprises a set of three tab members distributed equally around said second bracket component in cooperation with said support members.

5. A bracket system to provide quick and easy mountability for a ceiling fan, comprising:

a circular plate member having a slot therein for coupling by screws to a beam above said ceiling and a support member positioned at a side thereof comprising a ramp portion leading to a horizontally disposed portion of said support member, and a wire connecting a house circuit to a jack positioned on a lower side of said plate member, and an annular component attachable to a ceiling fan having a tab at a side thereof oriented to cooperate with said support member, and a plug assembly comprising a triangular insulated component holding a plug electrically connected to said ceiling fan and electrically adaptable to fit receivably into said jack of said plate member, whereby installing a ceiling fan comprises merely plugging said plug member into said jack member, then rotating said ceiling fan while said tab component is moving slidably along said ramp portion to move into a secure position against said horizontally disposed portion, thus securely positioning said ceiling fan.

6. A bracket system to provide quick and easy mountability for a ceiling fan, as described in claim 5, wherein:

said support member, including said ramp portion and said horizontally disposed portion, extends outwardly from a side of said circular plate member, and said tab member extends inwardly from a side of said annular component.

7. A bracket system to provide quick and easy mountability for a ceiling fan, as described in claim 6, wherein:

said support member includes a vertically disposed retainer member at an end of said horizontally disposed portion.

8. A bracket system to provide quick and easy mountability for a ceiling fan, as described in claim 7, wherein:

said bracket system comprises a set of three support members distributed equally around said circular plate member, and said bracket system comprises a set of three tab members distributed equally around said annular component in cooperation with said support members.

9. A bracket system to provide quick and easy mountability for a ceiling fan, comprising:

a first bracket component attachable to a ceiling having a tab at a side thereof in position to cooperate with a second bracket component, and a wire on an upper side of said first bracket attachable to a house circuit and to a jack positionable on a lower side of said first bracket, and a second bracket component attachable to a ceiling fan, said second bracket having a support member positioned at a side thereof comprising a ramp portion leading to a horizontally disposed portion of said support member in position to receive support from said tab member, and a plug assembly comprising an insulated component holding a plug member electrically connected to said ceiling fan and electrically adaptable to fit receivably into said jack of said first bracket, whereby installing a ceiling fan comprises merely plugging said plug member into said jack member, then rotating said ceiling fan while said tab component is moving slidably along said ramp portion to move into a secure position against said horizontally disposed portion, thus securely positioning said ceiling fan.

10. A bracket system to provide quick and easy mountability for a ceiling fan, as described in claim 9, wherein:

said support member, including said ramp portion and said horizontally disposed portion, extends inwardly from a side of said second bracket component, and said tab member extends outwardly from a side of said first bracket component.

11. A bracket system to provide quick and easy mountability for a ceiling fan, as described in claim 10, wherein:

said support member includes a vertically disposed retainer member at an end of said horizontally disposed portion.

12. A bracket system to provide quick and easy mountability for a ceiling fan, as described in claim 11, wherein:

said bracket system comprises a set of three support members distributed equally around said second bracket component, and said bracket system comprises a set of three tab members distributed equally around said first bracket component in cooperation with said support members.

* * * * *